US007816897B2

(12) United States Patent
Illegems

(10) Patent No.: US 7,816,897 B2
(45) Date of Patent: Oct. 19, 2010

(54) CURRENT LIMITING CIRCUIT

(75) Inventor: Paul F. Illegems, Tucson, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 1258 days.

(21) Appl. No.: 11/373,390

(22) Filed: Mar. 10, 2006

(65) Prior Publication Data

US 2007/0210726 A1 Sep. 13, 2007

(51) Int. Cl.
*G05F 1/573* (2006.01)

(52) U.S. Cl. ..... 323/277; 323/274; 323/284; 323/285; 323/312; 323/316

(58) Field of Classification Search ..... 32/238, 32/282, 284, 277, 266, 285, 312, 215–317
See application file for complete search history.

(56) References Cited

U.S. PATENT DOCUMENTS 5,789,971 A * 8/1998 Colletti et al. ..... 327/541
6,040,686 A * 3/2000 Schenkel ..... 323/282
6,407,537 B2 * 6/2002 Antheunis ..... 323/312
6,522,111 B2 * 2/2003 Zadeh et al. ..... 323/277
6,580,257 B2 * 6/2003 Marty ..... 323/280
7,057,310 B2 6/2006 Liu
7,064,532 B1 * 6/2006 Suzuki ..... 323/276
7,084,612 B2 8/2006 Zinn
7,102,334 B2 9/2006 Wiegand
7,173,405 B2 * 2/2007 Bo et al. ..... 323/312
7,459,891 B2 * 12/2008 Al-Shyoukh et al. ..... 323/274
7,602,162 B2 * 10/2009 Bansal et al. ..... 323/277
7,679,350 B2 * 3/2010 Falvey et al. ..... 323/284

* cited by examiner

*Primary Examiner*—Vibol Tan
(74) *Attorney, Agent, or Firm*—Meyertons Hood Kivlin Kowert & Goetzel, P.C.; Jeffrey C. Hood; Erik A. Heter

(57) ABSTRACT

An electronic circuit. The electronic circuit includes a pass transistor having a channel coupled between an input node and an output node. An error circuit is coupled thereto and configured to control the amount of current flowing through the pass transistor. The electronic circuit may further include a feedback node. A current limiting circuit is coupled to both the feedback node and the error circuit. The current limiting circuit is configured to limit an amount of current provided to the pass transistor by the error circuit based on a on a feedback voltage present on the feedback node and a current through a current mirror circuit, and therefore limits the output current provided by the electronic circuit.

25 Claims, 8 Drawing Sheets

CURRENT LIMITING CIRCUIT

BACKGROUND OF THE INVENTION

1. Field of the Invention

This invention relates to electronic circuits, and more particularly, to circuits utilizing current limiting.

2. Description of the Related Art

The use of voltage regulator circuits in electronic power supplies is very widespread. Voltage regulator circuits are used to provide a steady output voltage to the electronic circuit to which power is being supplied, typically referred to as the load. More particularly, the object of a voltage regulator circuit is to maintain a steady output voltage regardless of current drawn by the load.

FIG. 1 is a schematic diagram of one embodiment of a voltage regulator circuit. In the embodiment shown, an input voltage $V_{in}$ is provided on the node coupled to the source terminals of p-channel transistors MP1 and MP2. The voltage regulator circuit provides an output voltage from the drain terminal of transistor MP2. Current through transistors MP1 and MP2 is controlled via a feedback path between the junction of resistors R1 and R2 (which comprise a voltage divider circuit) and the inverting input to the operational amplifier of the circuit. The operational amplifier is an error amplifier, used in the circuit to indicate an error between a reference voltage $V_{ref}$ (which is provided to the non-inverting terminal of the operational amplifier) and the voltage present at the junction of R1 and R2, i.e., the feedback voltage, or $V_{fb}$. The operational amplifier is configured to provide an output signal that is proportional to the difference between the reference voltage and the feedback voltage, which is used to drive the gate terminal of n-channel transistor MN3. This in turn controls the current $I_3$ passing through transistor MN3. Since the drain terminal of transistor MN3 is coupled to the gate terminals of transistors MP1 and MP2, the value of $I_3$ affects both of these transistors. The effect may be greater on transistor MP2, whose gate width N is typically greater than MP1, in some cases by several orders of magnitude.

One measure of the effectiveness of a voltage regulator circuit is its ability to respond to system transients. For example, if the load coupled to a voltage regulator is an integrated circuit (IC) in which a large number of drivers may switch states simultaneously, the demand for current from the voltage regulator may change suddenly. An ideal voltage regulator is able to meet the demand for increased current while maintaining its designed output voltage $V_{out}$. However, this may not always be practical for a given voltage regulator circuit and a given load. In practice, a load capacitance (coupled between the voltage output node and ground) is typically provided in order to meet the immediate demand for increased current. Using the circuit shown in FIG. 1 as an example, a load having a suddenly increased demand for current initially receives current from the load capacitance (not shown). However, the load capacitance can only provide a finite amount of current, after which the voltage regulator circuit must provide current for both the load as well as for recharging the load capacitance. When this occurs, the feedback voltage may be pulled down somewhat (assuming discharge of the load capacitance), thereby causing the amplitude of the error signal produced by the error amplifier to increase. This in turn results in an increased amount of current through transistors MN3 and MP2. Eventually, the increased amount of current through MP2 will cause both the output and feedback voltages to be pulled up through the voltage divider network. However, if this does not occur rapidly enough, damage to the voltage regulator circuit could occur, particularly if the load capacitance is significantly discharged. Even if there is no damage to the voltage regulator circuit, the inability to respond to the increased current demand may result in the output voltage remaining well below its intended value for a duration long enough to cause erroneous operation of the circuit(s) that make up the load as the load capacitance is recharged.

Modern electronic systems have placed increased demands on the operation of voltage regulator circuits. IC's having a large number of I/O pins (and thus a large number of drivers) can significantly change the current demand from a power supply system in an instant. Due to the high operational speed at which many IC's operate, voltage regulator circuits must be able to respond to this changing demand while maintaining an both an output voltage within a specified tolerance and the ability to recharge the load capacitance. This requires a voltage regulator circuit that responds quickly to transients. Furthermore, in some situations, a circuit used to implement a voltage regulator may be subject to short circuit or overload conditions for a significant amount of time. In such cases, the circuit may become damaged without protection against excessive currents that may result from such conditions. Similarly, other types of circuits (e.g., amplifiers) may also be susceptible to problems similar to those discussed above with regard to voltage regulators.

SUMMARY OF THE INVENTION

An electronic circuit is disclosed. In one embodiment, the electronic circuit includes a pass transistor having a channel coupled between an input node and an output node. An error circuit is coupled thereto and configured to control the amount of current flowing through the pass transistor. The electronic circuit may further include a feedback node. A current limiting circuit is coupled to both the feedback node and the error circuit. The current limiting circuit is configured to limit an amount of current provided to the pass transistor by the error circuit based on a on a feedback voltage present on the feedback node and a current through a current mirror circuit, and therefore limits the output current provided by the electronic circuit.

In one embodiment, the current limiting circuit includes a transistor having a channel coupled between the error circuit and ground node. If the feedback voltage falls below the transistor's threshold voltage, the transistor will turn off and thereby limit the amount of current flowing between the input node and the ground node (and thus limit current through both the current mirror and the error circuit). In this manner, short circuit current is limited using a technique known as foldback current limiting. Embodiments that do not utilize foldback limiting are also possible and contemplated.

In various embodiments, the electronic circuit may include multiple feedback paths, multiple error circuits, and/or multiple current mirror circuits. In one embodiment, the electronic circuit includes a first feedback path coupled to provide a feedback voltage to an error circuit and a second feedback path coupled to provide a second feedback voltage to the current limiting circuit.

The electronic circuit may be used in various applications. For example, the electronic circuit may be implemented as a voltage regulator in one application, or may be implemented as an amplifier in another application. In general, the circuit may be used in any application where foldback current limiting is desired.

BRIEF DESCRIPTION OF THE DRAWINGS

Other aspects of the invention will become apparent upon reading the following detailed description and upon reference to the accompanying drawings in which:

FIG. 8 is a graph illustrating the relationship between output voltage and output current for the embodiment illustrated in. FIG. 7.

Figure 1:
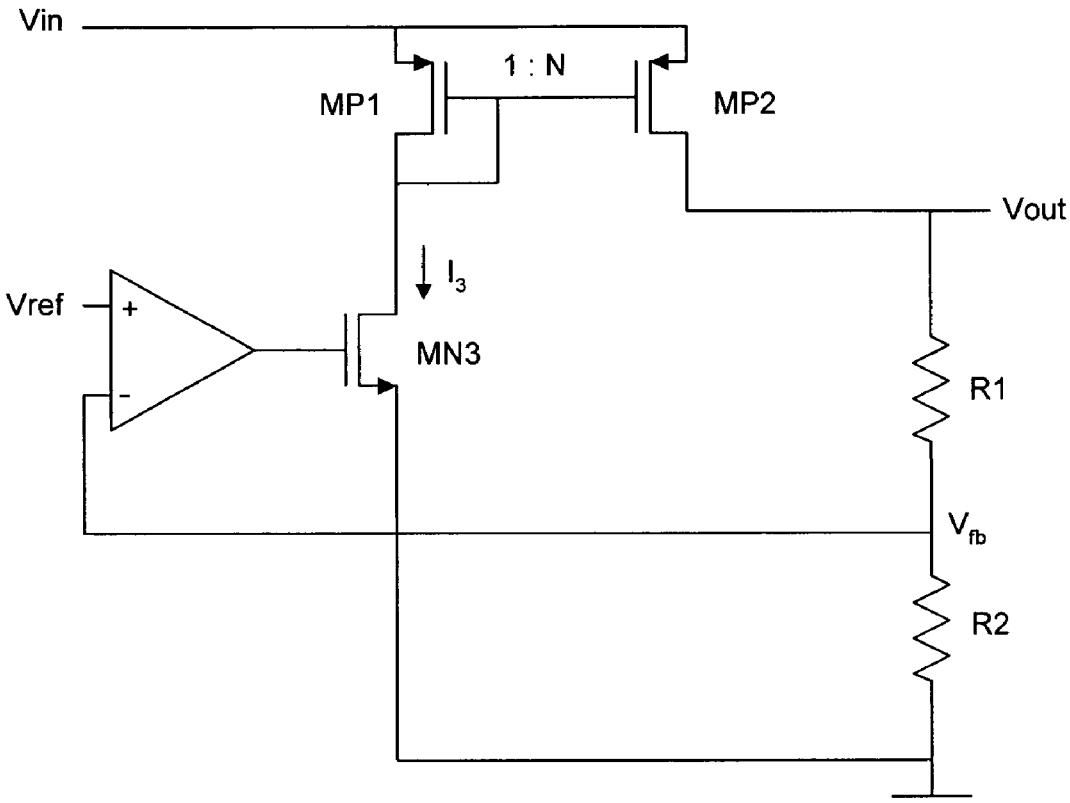
Fig. 1 (Prior Art)
FIG. 1 (Prior Art) is a schematic diagram of one embodiment of a voltage regulator circuit.

While the invention is susceptible to various modifications and alternative forms, specific embodiments thereof are shown by way of example in the drawings and will herein be described in detail. It should be understood, however, that the drawings and description thereto are not intended to limit the invention to the particular form disclosed, but, on the contrary, the invention is to cover all modifications, equivalents, and alternatives falling with the spirit and scope of the present invention as defined by the appended claims.

DETAILED DESCRIPTION OF THE INVENTION

Figure 2:
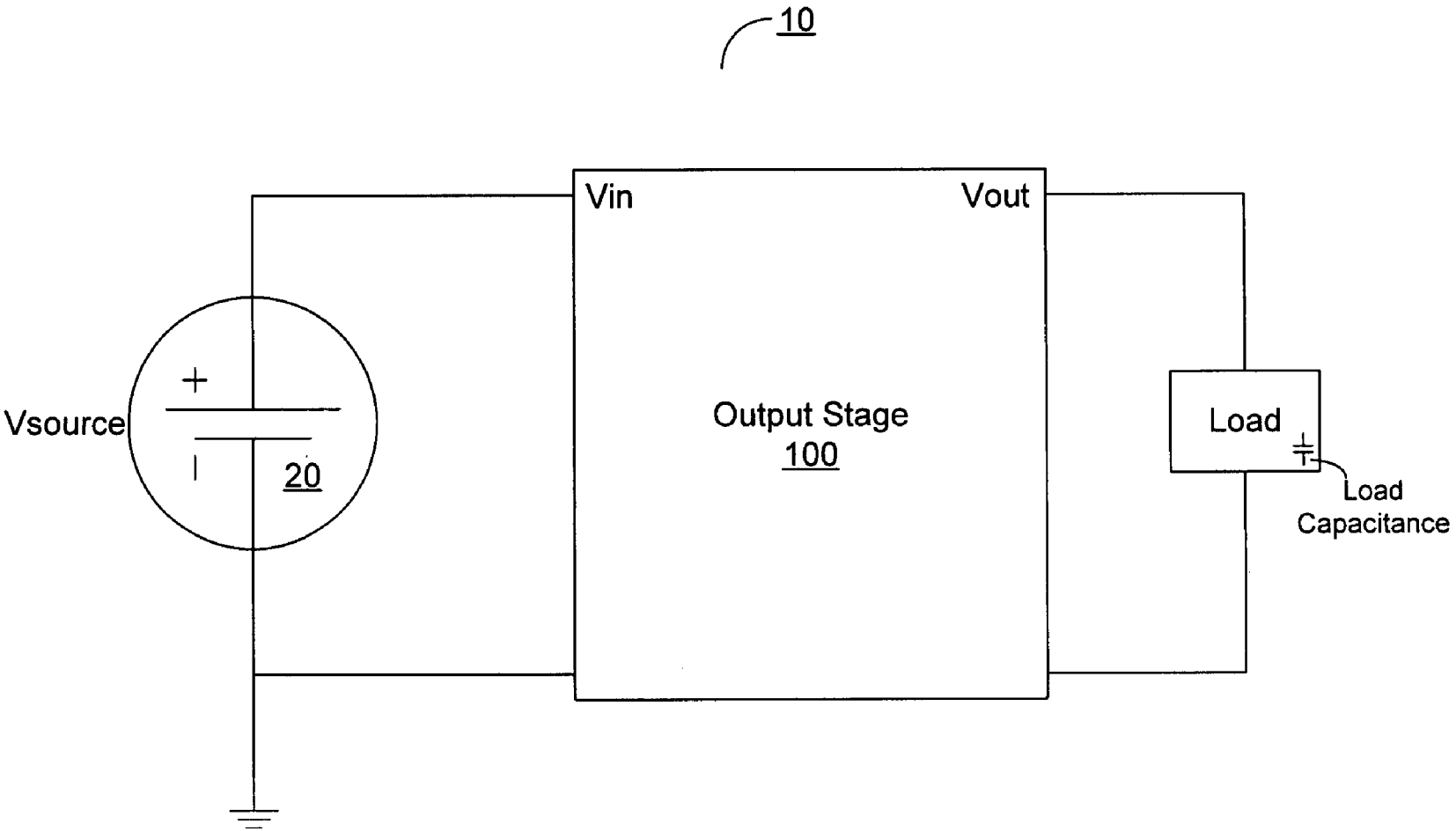
FIG. 2 is a block diagram of one embodiment of a voltage regulator.

Turning now to FIG. 2, a block diagram of one embodiment of a voltage regulator is shown. In the embodiment shown, voltage regulator 10 includes a voltage source 20 coupled to an output stage 100. Voltage source 20 is configured to provide a source voltage (Vsource) to the output stage. Output stage 100 is configured to regulate the source voltage and thereby provide a steady output voltage Vout. It should be noted that the output voltage may be less than the input voltage. More particularly, output stage 100 is configured to respond to changing current demand by the load while maintaining a steady output voltage. The load may be one of many different types of electronic circuits or systems. For example, the load may be a computer system. During operation of the computer system, simultaneous switching by a large number of circuits may cause a rapid change in the amount of current demanded from output stage 100. As such, output stage 100 is designed to respond to the changing current demand while maintaining the output voltage at a substantially constant level. It is noted that the load shown herein includes a load capacitance. The load capacitance may include one or more capacitors coupled between the output node of the voltage regulator and the ground node. This capacitance may source current in response to a rapid change in current demand as the voltage regulator responds.

Figure 3:
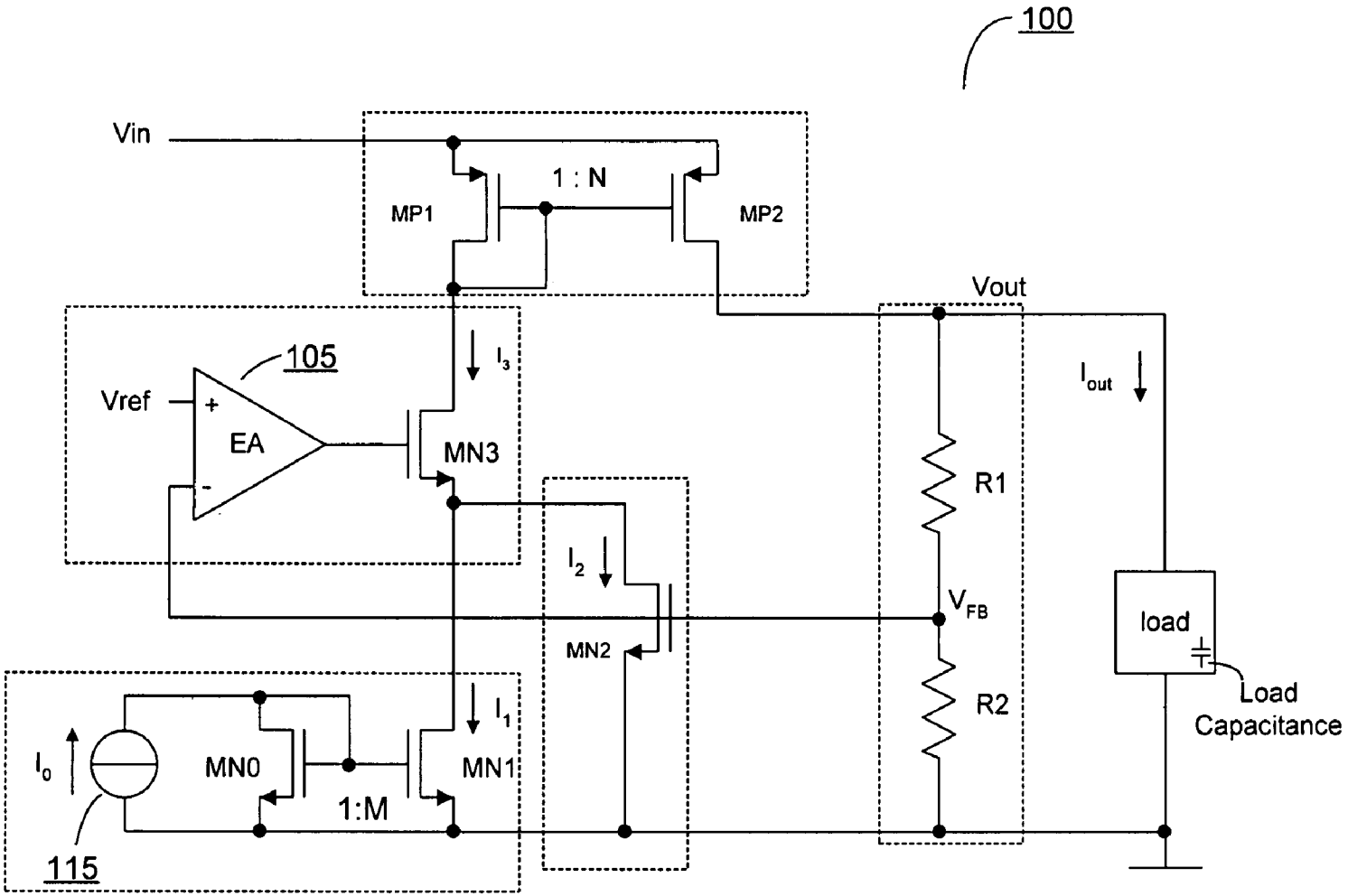
FIG. 3 is a schematic diagram of one embodiment of a voltage regulator having a current limiting circuit.

Moving now to FIG. 3, a schematic diagram of one embodiment of a voltage regulator having a current limiting circuit is illustrated. More particularly, FIG. 3 is a schematic diagram of output stage 100. For ease of understanding, output stage 100 is shown here as coupled to a load.

Output stage 100 as shown here is functionally divided into several different circuits, as noted by the dashed-line boxes. In the embodiment shown, output stage 100 includes a first current mirror (which includes transistor MP1 and a pass transistor MP2), an error circuit (which includes error amplifier 105 and transistor MN3), a current limiting circuit (which includes transistor MN2 and also uses the current mirror circuit comprising MN1) and a voltage divider (which includes series-coupled resistors R1 and R2 between Vout and ground). As previously noted, the circuit also includes the second current mirror of MN1, and also includes transistor MN0. Transistors MN0 and MN1 are sized with respect to each other by a ratio of 1:M. A preset current limit is set in this circuit based on the sizes of MN0 and MN1 and the current provided by current source 115.

An input voltage may be provided to output stage 100 on the input voltage node, Vin, which is coupled to the source terminal of pass transistor MP2. An output voltage is conveyed from the output node, which is coupled to the drain terminal of MP2. The amount of current passing through the channel of MP2 may be determined by operation of the current mirror circuit that comprises MP2. It should be noted that embodiments where pass transistor MP2 is implemented without the use of a current mirror are possible and contemplated, although use of the current mirror circuit may provide more control over the output current. Both transistors of the current mirror circuit in this embodiment are metal-oxide semiconductor (MOS) transistors, and more particularly, PMOS transistors (hence the designation 'MP'; NMOS transistors discussed herein are designated 'MN'). During normal operation of the circuit, when current is not limited, transistors MN1 and MN2 operate in the triode region. That is, for those transistors operating in the triode region during normal operation of the voltage regulator. When current is limited (as will be discussed further below), transistor MN1 operates in the saturation region, while transistor MN2 may be turned off.

Current passing through both MP1 and MP2 is controlled by current $I_3$, which flows from the gate terminals of each of these transistors. This current is controlled in large part by the error circuit, the operation of which will be discussed in further detail below. In this embodiment, the width-to-length (W/L) ratio of transistor MP2 is significantly greater than that of MP1, and thus it can source more current to the output node Vout. In some embodiments, the W/L ratio of MP2 may be one or more orders of magnitude greater than that of MP1. The relationship between the W/L ratio of MP1 to the W/L ratio of MP2 may also be expressed as 1:N, with N being one or more orders of magnitude greater than 1.

As previously noted, current $I_3$ is determined in large part by the operation of the error circuit. The error circuit in this embodiment includes error amplifier 105 and NMOS transistor MN3. Error amplifier 105 is coupled to receive a reference voltage, Vref, at its non-inverting input, and a feedback voltage, $V_{FB}$, at its inverting input. The feedback voltage is derived from the voltage divider circuit, and in this embodiment is taken from the junction of resistors R1 and R2. Error amplifier 105 is configured to produce an output signal that may vary depending on the difference in magnitude between the reference voltage and the feedback voltage. In this particular example, the error signal may be proportional to the difference between the voltage magnitudes. The resulting error signal is driven to the gate terminal of transistor MN3, which in turn varies the amount of current ($I_3$) flowing through its channel accordingly.

Output stage 100 includes a current limiting circuit, which in this embodiment comprises transistor MN2, and also includes the current mirror comprising transistor MN1. Transistor MN2 is one of two transistors in this embodiment having a drain terminal coupled to the source terminal of transistor MN3, the other one being MN1. This junction may be referred to as the limit node, since the current flowing into this node, 13, is limited by the operation of transistors MN1 and MN2.

The circuit configuration shown here including the current limiting circuit and the current mirror of MN1, MN0, and current source 115 effectively forms a current divider circuit. Current $I_3$ is split into two currents, $I_1$ and $I_2$. The amount of current $I_1$ is determined by the current divider circuit comprising MN1. Current $I_1$ may mirror the current through current source 115, which provides current $I_0$ to the gate terminals of MN1 and MN0. Above a certain operating point, current $I_1$ may be kept relatively constant. Since current $I_0$ (and therefore $I_1$) is held relatively constant and current $I_3$ cannot exceed $I_1+I_2$, variations in $I_3$ in this embodiment will be reflected in the amount of current flowing through transistor MN2.

During the operation of output stage 100, transients in the load may pull the voltage on the output node somewhat lower than the normal Vout set point. In this embodiment, the set point for the output voltage is $$Vout = Vref \times \frac{(R1 + R2)}{R2}.$$

Thus, if the output voltage is pulled below this set point, the control loop of the circuit may respond by increasing the value of current $I_3$ to meet the increased current demand at the output. In such a case, the gate terminal of MN2 is driven with a voltage proportional to the output voltage, thereby allowing a certain amount of current $I_2$ and thus an amount of current $I_3$ that may exceed current $I_1$, which cannot exceed $M \times I_0$ in this embodiment. Therefore, the amount of current flowing through MN2, when turned on, is controlled by the feedback voltage, and may allow a larger current $I_3$ than that which would be allowed by the current $I_0$ provided by current source 115.

Transistor MN2 may be turned on or off depending on the voltage present on the feedback node of the voltage divider circuit (i.e. $V_{FB}$). If the feedback voltage falls below the threshold voltage of transistor MN2, it will turn off and thus current $I_3$ will be limited to the amount of current flowing through MN1 of the current mirror, $I_1$. Thus, if the output voltage is pulled sufficiently low by a transient in the load (or a short circuit), the current through transistors MP1, MP2, and MN3 may be limited to an amount that prevents damage to the circuit. Furthermore, limiting the current through MP2 limits the output current, $I_{out}$.

In addition to limiting the current, the use of the current limiting circuit may also provide faster operation than a circuit with a conventional feedback loop. Since the feedback node is directly coupled to the gate of MN2, any change in the feedback voltage may act faster on this transistor than on the error circuit. This is due to the fact that the error circuit must measure the difference, amplify the signal, and provide the amplified signal to its output. In contrast, when the feedback voltage changes, the voltage on the gate terminal of MN2 also changes at substantially the same time, and thus varies the current $I_2$, and thus $I_3$.

The second current mirror including transistors MN0 and MN1 may provide for sufficient current to flow to allow for the circuit to power up or to recover from a large transient. In embodiments such as the one shown in FIG. 3, the amount of current flowing through transistor MN1 ($I_1$) will typically be small relative to $I_3$, but sufficient for power up or transient recovery.

Figure 4:
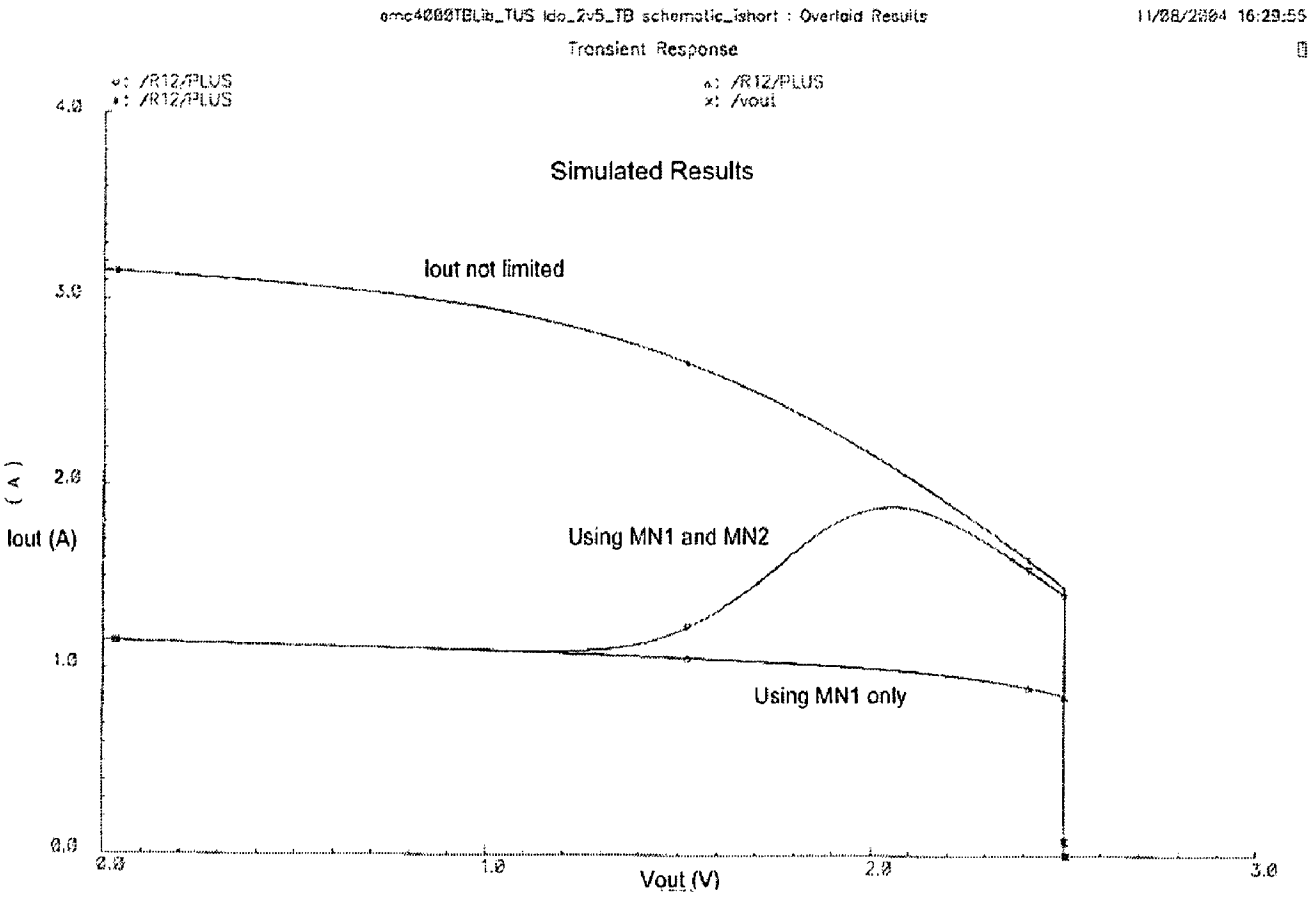
FIG. 4 is a graph illustrating the performance of the embodiment of the voltage regulator illustrated in FIG. 3.

FIG. 4 is a graph illustrating the performance of the embodiment of the voltage regulator illustrated in FIG. 3. More particularly, FIG. 4 is a graph illustrating output voltage vs. output current for the embodiment of FIG. 3, along with separate curves for comparison. One of the separate curves compares the operation of the embodiment of FIG. 3 with an embodiment that includes transistor MN1 (and thus the current mirror including MN0) but not MN2, while the other curve illustrates the operation of an embodiment wherein the output current is not limited. Each of the curves illustrates a transient response of its respective circuit when the output voltage falls from its target output voltage down to 0 volts. For each of the curves shown, the following values are assumed:

Vin=3.3 volts
Vout=2.5 volts (target output voltage)
$V_{FB}$=1.22 volts (when Vout @ target voltage)
Vref=1.22 volts
Ratio N: 20,000
MP2 W/L=24,000/0.35.

As can be seen by examining the curve for the embodiment including MN1 and MN2, current at Vout=2.5 volts is approximately 1.5 amperes. As the output voltage falls, the current increases, peaking at around an output voltage of approximately 2.0 volts. This rise in current is due to the operation of the error circuit. As the output voltage falls, the feedback voltage falls as well, resulting in a larger error signal output by error amplifier 105. At this point, the operation of transistor MN3 is dominant on the curve, as current $I_3$ initially increases as the output voltage falls from its target output voltage. During normal operation of the circuit, the increase in current through MP2 (which results in the increase in $I_{out}$) is typically sufficient to pull the output voltage back up to its target.

As the output voltage falls below approximately 2.0 volts, the effect of the current limiting circuit (more particularly, transistor MN2 in the embodiment of FIG. 3) begins to dominate the curve. Output current begins to fall as the output voltage falls below 2.0 volts. The curve flattens out at approximately 1.2 amperes at an approximate output voltage of 1.5 volts. At this point, transistor MN2 is off, as the feedback voltage is less than the threshold voltage for turning on MN2. As the output voltage falls below this point, the output current stays remains relatively steady down to 0 volts, limited by the current set in the current mirror of transistor MN1 since MN2 remains turned off. This type of current limiting is sometimes referred to as foldback current limiting. Foldback current limiting may provide the advantage of delivering more current to the load when Vout is close to its target value while the short circuit current can be kept small independently.

In contrast to the circuit of FIG. 3, the embodiment represented by the curve where the output current is not limited shows an increase in output current as the voltage falls from the target voltage to 0 volts. As the voltage falls, the output current increases from approximately 1.5 amperes to approximately 3.2 amperes. This increase in current may have adverse affects on the output stage, the load, or both, and may thus be undesirable.

For the embodiment represented by the curve where only MN1 is used (i.e., similar to that shown in FIG. 3, minus transistor MN2), the output current is significantly lower at the target voltage (approximately 1.0 amperes) in comparison to the other embodiments. Furthermore, the current does not appreciably increase as the output voltage falls, leveling off at approximately 1.2 amperes at an output voltage of 0 volts. Thus, an embodiment of a circuit represented by this curve, while limiting the current, may be less responsive to system transients involving a small drop in the output voltage. Nevertheless, such an embodiment may be useful in applications where the current limiting behavior is desired or required, while the foldback behavior is not desired.

Figure 5:
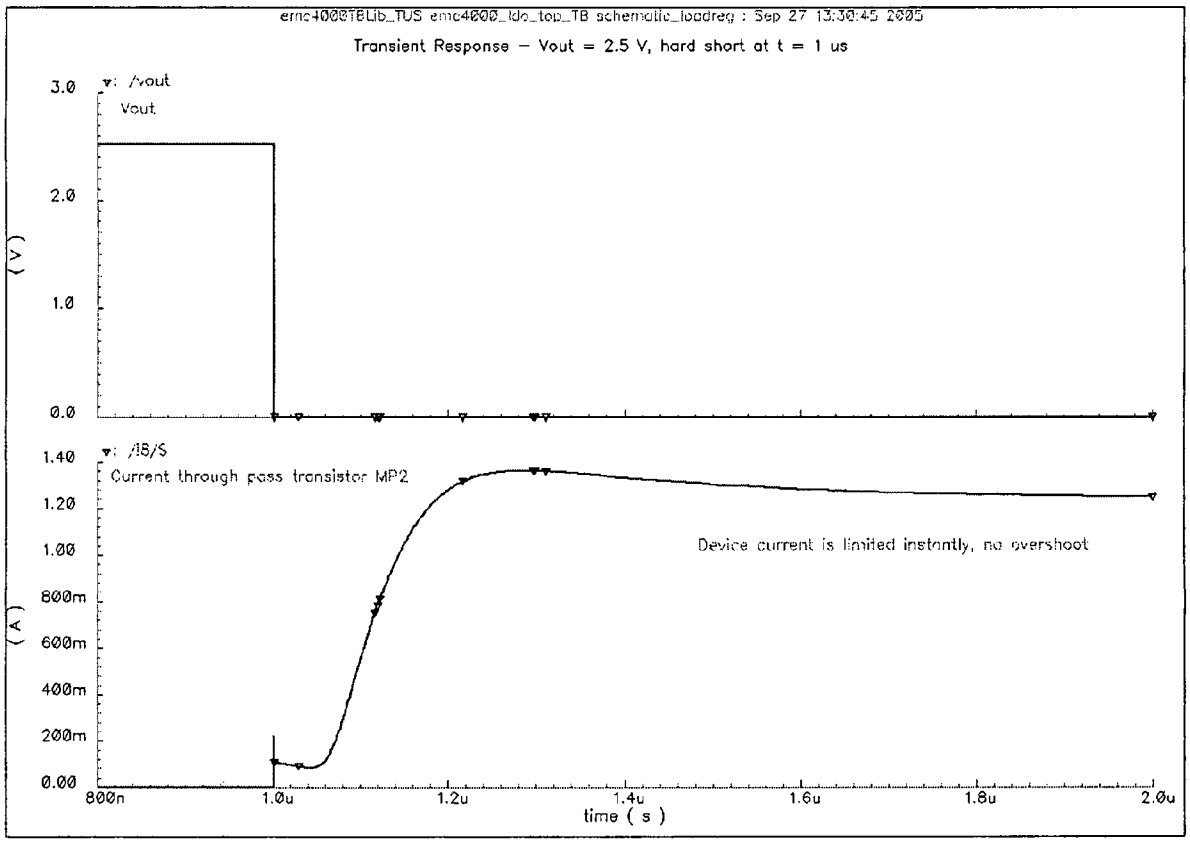
FIG. 5 is a graph illustrating output current through a portion of the embodiment illustrated in FIG. 3.

FIG. 5 is a graph illustrating short circuit current through a portion of the embodiment illustrated in FIG. 3. More particularly, FIG. 5 illustrates the transient current response through transistor MP2 vs. time when the output node is shorted to ground. The values used for this example are the same as those given above in reference to FIG. 4.

The example shown begins with the output voltage at 2.5 volts. At this point, the current through MP2 is 0 amperes. At 1.0 μs, the output node of the circuit is hard shorted to ground. Between 1.0 μs and approximately 1.2 μs, current through MP2 rises to approximately 1.4 amperes, before settling at approximately 1.3 amperes. Thus the device current is limited in very short order with almost no overshoot. Because the limiting effect is fast acting, it will effectively limit any inrush current (from Vin) at power up, when the load capacitance is charged.

Figure 6:
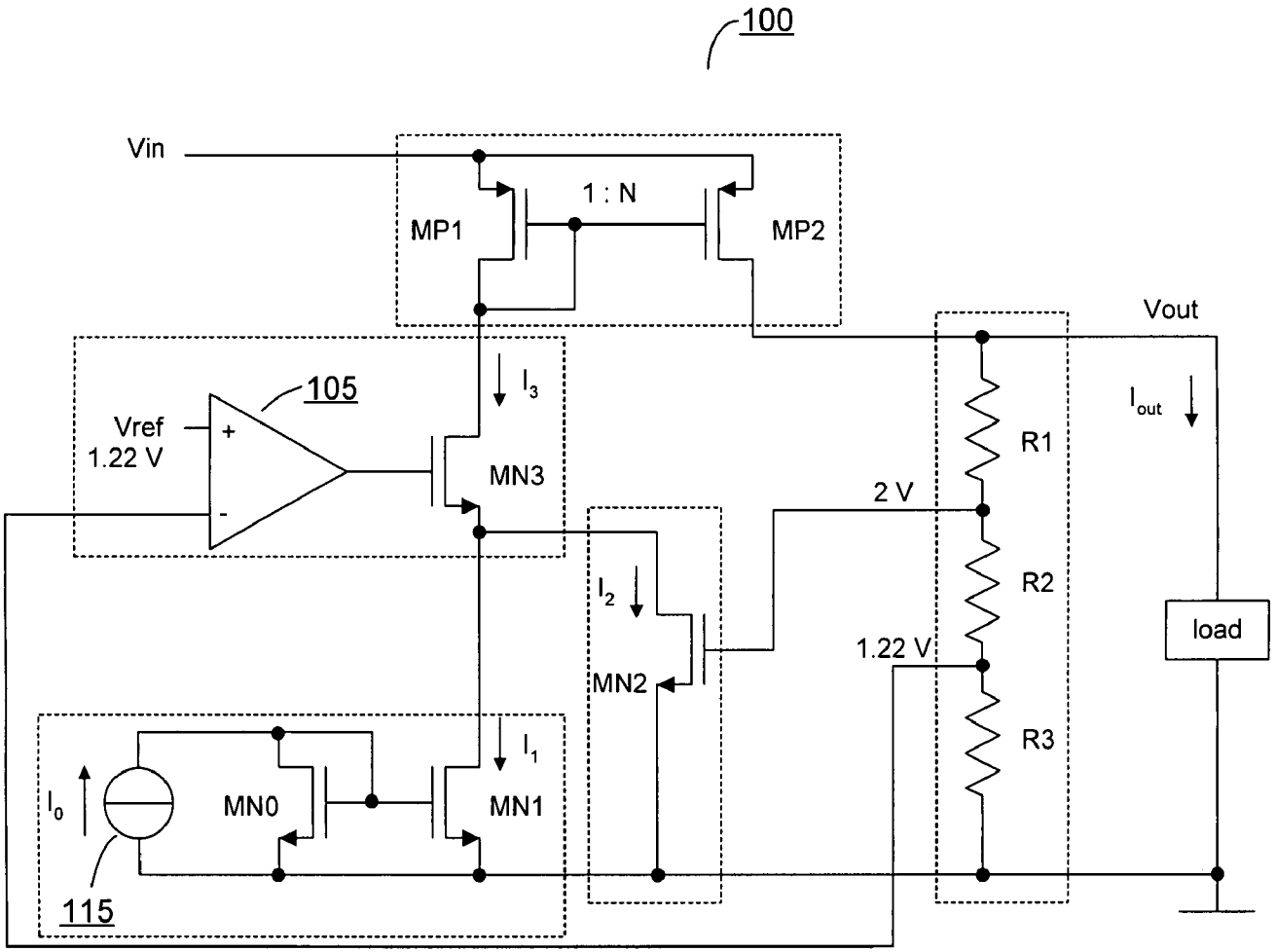
FIG. 6 is a schematic diagram of an embodiment of a voltage regulator circuit having multiple feedback paths.

Moving now to FIG. 6, a schematic diagram of an embodiment of a circuit having multiple feedback paths is shown. The multiple feedback paths in this embodiment are implemented by utilizing three resistors in the voltage divider circuit and tapping the feedback voltages off of the separate intermediate nodes. The operation of this embodiment is similar to the operation of the embodiment shown in FIG. 3. The primary difference is the use of different feedback paths (and different feedback voltages) for the current limiting circuit and the error circuit. Utilizing this configuration may result in a circuit where the current level through MN2 is less dependent on the feedback voltage received on its gate. Since the feedback voltage received on the gate of MN2 is greater than the feedback voltage received by the error circuit, the high current region of the transient response (e.g., such as that shown in the graph of FIG. 4) may be wider, with the error circuit (error amplifier 105 and transistor MN3) having a greater effect on the output current.

As an alternative to the embodiment shown in FIG. 6, the circuit may be arranged such that the feedback voltage received on the gate of MN2 is less than the feedback voltage received by the error circuit. In such a circuit, the high current region of the transient response may be narrower than for the embodiment of the circuit whose operation was illustrated in FIG. 4.

Figure 7:
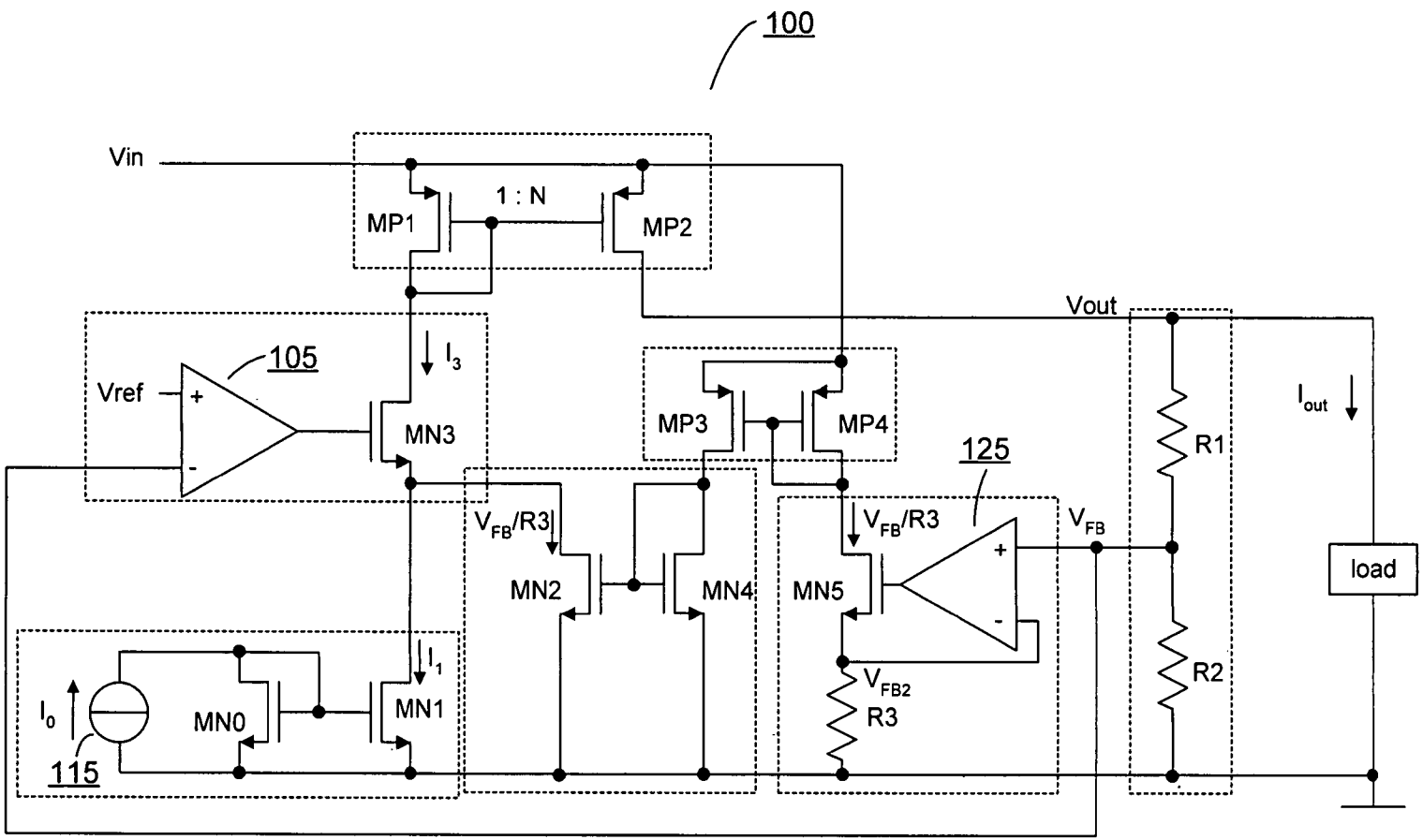
FIG. 7 is a schematic diagram of an embodiment of a voltage regulator circuit implemented using multiple current mirrors.

FIG. 7 illustrates yet another circuit embodiment. More particularly, FIG. 7 is a schematic diagram of an embodiment of a voltage regulator circuit implemented using multiple current mirrors. In the embodiment shown, the current limiting circuit is implemented using a current mirror which includes transistor MN2. Current through the limiting circuit is controlled by yet another current mirror (which includes transistors MP3 and MP4), which is in turn controlled by a second error circuit. The second error circuit includes error amplifier 125, transistor MN5, which is coupled to receive the output signal of error amplifier 125 on its gate terminal, and resistor R3, which is coupled between the source terminal of MN5 and circuit ground.

Figure 8:
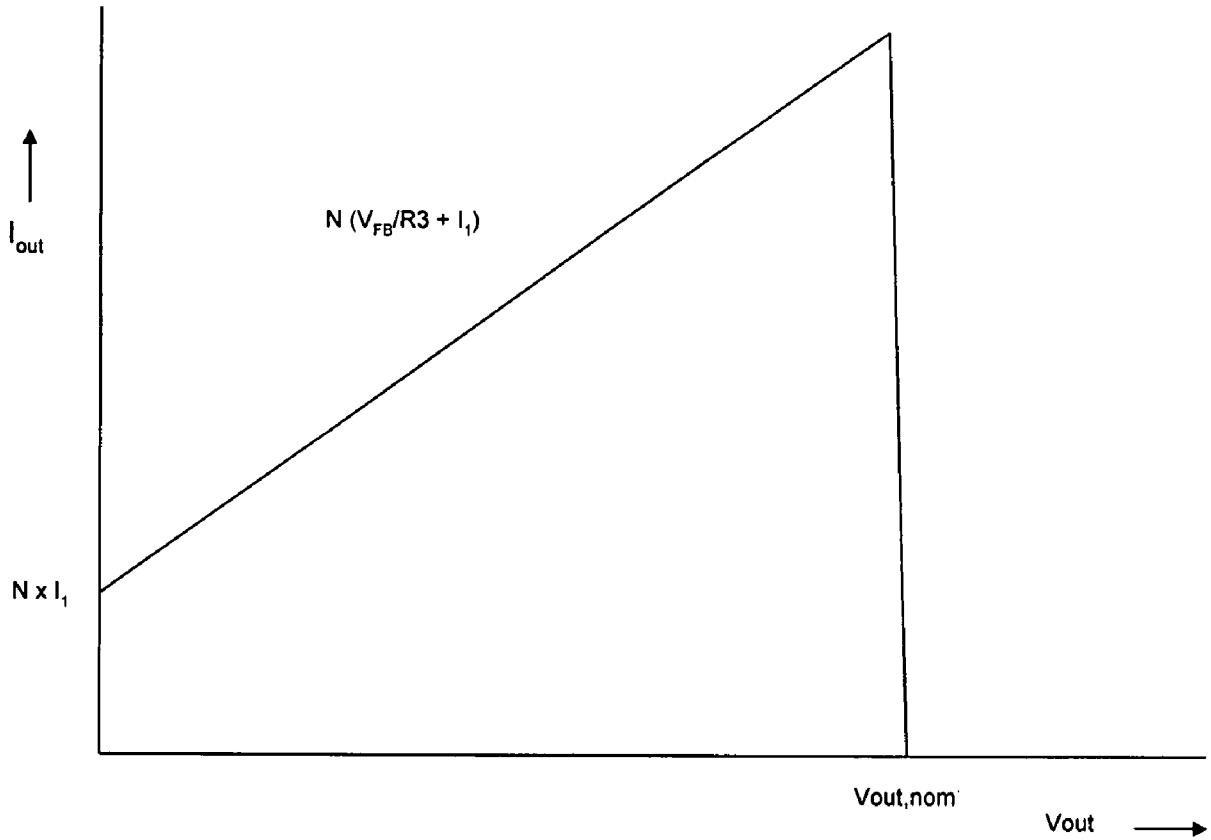

In this circuit embodiment, the current flowing through MN5 is equal to $V_{FB}/R3$. This current is mirrored to MN2. In turn, MN2 limits the output current to $N(V_{FB}/R_3+I_1)$. Thus, for this circuit, the output current is proportional to the output voltage, as shown in FIG. 8. In general, as illustrated by the various embodiments discussed herein, the shape of the foldback can be easily modified by shaping the curve of the feedback voltage to a transistor (e.g., MN2 in FIGS. 4, 6, and 7) in the current limiting circuit. In the embodiment of FIG. 3, this is accomplished by coupling the gate of MN2 directly to a single feedback node. The shape of the foldback of the embodiment shown in FIG. 6 differs from that of the embodiment of FIG. 3 by virtue of coupling the gate of MN2 to a different feedback node than that coupled to the inverting input of error amplifier 105. In the embodiment of FIG. 7, yet another alternative foldback curve is provided by incorporating MN2 into a current mirror and indirectly coupling it to the feedback voltage via a second error circuit and yet another current mirror (comprising MP3 and MP4).

Although the various embodiments of the circuits discussed herein are implemented using MOS transistors, embodiments using bipolar transistors are also possible and contemplated. Embodiments based on transistors opposite of the type of the embodiments shown (i.e. PMOS vs. NMOS) are also possible and contemplated. Specific voltage and current values discussed herein are exemplary. Furthermore, while the circuits have been described herein in terms of use in voltage regulators, these circuits may be used as amplifiers or for other functions. In general, the circuits described herein may be used for any functional implementation where such operation (e.g., foldback current limiting) is required or desired.

While the present invention has been described with reference to particular embodiments, it will be understood that the embodiments are illustrative and that the invention scope is not so limited. Any variations, modifications, additions, and improvements to the embodiments described are possible. These variations, modifications, additions, and improvements may fall within the scope of the inventions as detailed within the following claims.

What is claimed is:

1. An electronic circuit comprising:

a pass transistor including a channel coupled between an input node and an output node;

a first feedback node;

a first error circuit coupled to the pass transistor, wherein the first error circuit is configured to control an amount of current flowing through the pass transistor based on a first feedback voltage present on the first feedback node; and a current limiting circuit coupled to the error circuit, wherein the current limiting circuit is configured to limit an amount of current flowing through the error circuit based on a preset current limit; wherein the current limiting circuit includes a transistor having a control terminal coupled to the first feedback node and a channel coupled between the error circuit and a ground node, wherein the transistor is configured to turn off if the first feedback voltage falls below a threshold voltage of the transistor.

2. The electronic circuit as recited in claim 1, wherein the first error circuit is configured to control an amount of current flowing through the pass transistor based on a difference between a reference voltage and the first feedback voltage.

3. The electronic circuit as recited in claim 1, wherein the electronic circuit further comprises a voltage divider circuit, wherein the voltage divider circuit includes a plurality of resistors coupled between the output node and the ground node, and wherein the first feedback node exists at a junction between a first and a second one of the plurality of resistors.

4. The electronic circuit as recited in claim 3, wherein the plurality of resistors includes a third resistor, wherein a second feedback node exists at a junction between the second and third ones of the plurality of resistors.

5. The electronic circuit as recited in claim 4, wherein the first feedback node is coupled to the first error circuit and wherein the second feedback node is coupled to a control terminal of a transistor of the current limiting circuit, and wherein the first error circuit is configured to control an amount of current flowing through the pass transistor based on difference between a reference voltage and the first feedback voltage.

6. The electronic circuit as recited in claim 1, wherein a first current mirror comprises the pass transistor and wherein the current limiting circuit comprises a second current mirror, wherein the second current mirror circuit includes a transistor having a channel coupled between the first error circuit and a ground node.

7. The electronic circuit as recited in claim 6, wherein the electronic circuit further comprises:

a third current mirror, wherein the third current mirror is coupled to the second current mirror and configured to control an amount of current flowing through the second current mirror;

a second error circuit coupled to coupled to the third current mirror and the voltage divider circuit, wherein the second error circuit is configured to control an amount of current flowing through the third current mirror based on a difference between the first feedback voltage and a voltage across a resistor coupled between the second error circuit and a ground node.

8. The electronic circuit as recited in claim 7, wherein an amount of current flowing through the second current mirror and the second error circuit is determined by dividing the first feedback voltage by a resistance value of the resistor coupled between the second error circuit and the ground node.

9. The electronic circuit as recited in claim 1, wherein the current limiting circuit is configured to provide foldback current limiting.

10. An electronic circuit comprising:

an input node;

an output node, wherein the output node is operatively coupled to the input node by a channel of a first transistor;

a first feedback node;

a first error circuit including a first amplifier and a second transistor having a control terminal coupled to an output of the first amplifier, and a channel coupled between a control terminal of the first transistor and a limit node, wherein the first error circuit is configured to control an amount of current flowing through the pass transistor based on a first feedback voltage present on the first feedback node;

a current limiting circuit, wherein the current limiting circuit includes a third transistor having a channel coupled between the limit node and the ground node, and wherein the current limiting circuit is configured to limit the current through the channel of the second transistor based on a preset current limit.

11. The electronic circuit as recited in claim 10, wherein the third transistor is operatively coupled to the first feedback node, and wherein the third transistor has a threshold voltage, and wherein the third transistor is configured to be turned off if the first feedback voltage falls below the threshold voltage.

12. The electronic circuit as recited in claim 10, wherein the first amplifier is coupled to receive a reference voltage on a non-inverting input and the first feedback voltage present on an inverting input and further configured to provide an error signal on the first amplifier output, wherein a magnitude of the error signal is proportional to a difference between the reference voltage and the voltage on the first feedback node, and wherein an amount of current present on the control terminal of the first transistor is determined in part by the magnitude of the error signal.

13. The electronic circuit as recited in claim 10, wherein the electronic circuit further comprises a voltage divider circuit, wherein the voltage divider circuit includes a plurality of resistors coupled between the output node and the ground node, and wherein the first feedback node exists at a junction between a first and a second one of the plurality of resistors.

14. The electronic circuit as recited in claim 13, wherein the voltage divider includes a second feedback node at a junction between the second and a third resistor, wherein the first feedback node is coupled to an inverting input of the first amplifier, and wherein the second feedback node is directly coupled to the control terminal of the third transistor.

15. The electronic circuit as recited in claim 10, wherein the electronic circuit further includes:

a first current mirror circuit having a channel of a fourth transistor coupled between the limit node and the ground node, wherein the current limiting circuit includes the first current mirror circuit; and a second current mirror circuit including the first transistor and a fifth transistor, wherein a channel of the fifth transistor is coupled between the input node and the output node.

16. The electronic circuit as recited in claim 15, wherein the current limiting circuit includes a third current mirror circuit, the third current mirror circuit including the third transistor.

17. The electronic circuit as recited in claim 16, wherein the voltage regulator circuit further includes:

a second error circuit, wherein the second error circuit includes a second amplifier and a sixth transistor having a control terminal coupled to an output of the second amplifier;

a fourth current mirror circuit coupled between the second error circuit and the second current mirror circuit;

wherein the second error circuit controls an amount of current flowing through the fourth current mirror circuit, and wherein the fourth current mirror circuit controls an amount of current flowing through the third current mirror circuit.

18. The electronic circuit as recited in claim 17, wherein each of the first and second amplifiers includes an inverting input and a non-inverting input, wherein the first amplifier is coupled to receive a reference voltage on its non-inverting input and the first feedback voltage on its inverting input, and wherein the second amplifier is coupled to receive the first feedback voltage on its non-inverting input and a second feedback voltage on its inverting input.

19. The electronic circuit as recited in claim 18, wherein the second feedback voltage is generated by current flowing through a resistor coupled between a channel of the sixth transistor and the ground node.

20. The electronic circuit as recited in claim 14, wherein a channel width of the fifth transistor is related to a channel width of the first transistor by a ratio of 1:N, wherein N is greater than 1.

21. The electronic circuit as recited in claim 19, wherein N is at least one order of magnitude greater than 1.

22. The electronic circuit as recited in claim 10, wherein the current limiting circuit includes a current mirror including the third transistor.

23. The electronic circuit as recited in claim 10, wherein the current limiting circuit is configured to provide foldback current limiting.

24. A method of operating an electronic circuit, the method comprising:

providing an input voltage to the electronic circuit;

the electronic circuit providing an output voltage and an output current in response to the input voltage;

varying the output current dependent a feedback voltage, wherein the feedback voltage is dependent upon the output voltage; and limiting the output current to a predetermined current value using a current limiting circuit if the feedback voltage falls below a predetermined threshold, wherein said limiting includes turning off a transistor having a control terminal coupled to receive the feedback voltage if the feedback voltage falls below a threshold voltage of the transistor.

25. An electronic circuit comprising:

a pass transistor including a channel coupled between an input node and an output node;

a first feedback node;

a first error circuit coupled to the pass transistor, wherein the first error circuit is configured to control an amount of current flowing through the pass transistor based on a first feedback voltage present on the first feedback node; and a current limiting circuit coupled to the error circuit, wherein the current limiting circuit is configured to limit an amount of current flowing through the error circuit based on a preset current limit;

wherein the electronic circuit further comprises a voltage divider circuit, wherein the voltage divider circuit includes a plurality of resistors coupled between the output node and the ground node, and wherein the first feedback node exists at a junction between a first and a second one of the plurality of resistors;

wherein the plurality of resistors includes a third resistor, wherein a second feedback node exists at a junction between the second and third ones of the plurality of resistors.

* * * * *